US009157235B1

(12) United States Patent
Garvey

(10) Patent No.: US 9,157,235 B1
(45) Date of Patent: Oct. 13, 2015

(54) GEODESIC FRAME SYSTEM

(71) Applicant: Michael Edward Garvey, Schererville, IN (US)

(72) Inventor: Michael Edward Garvey, Schererville, IN (US)

( * ) Notice: Subject to any disclaimer, the term of this patent is extended or adjusted under 35 U.S.C. 154(b) by 0 days.

(21) Appl. No.: 14/227,173

(22) Filed: Mar. 27, 2014

(51) Int. Cl.
*E04B 7/10* (2006.01)
*E04B 1/32* (2006.01)
*E04B 1/38* (2006.01)

(52) U.S. Cl.
CPC . *E04B 7/105* (2013.01); *E04B 1/32* (2013.01); *E04B 1/38* (2013.01); *E04B 2001/327* (2013.01); *E04B 2001/3241* (2013.01); *E04B 2001/3247* (2013.01); *E04B 2001/3276* (2013.01)

(58) Field of Classification Search
CPC ..... E04B 7/105; E04B 1/38; E04B 1/32; E04B 2001/327; E04B 2001/3276; E04B 2001/3247; E04B 2001/3241
USPC ..... 52/71, 81.1, 81.2, 81.3, DIG. 10, 655.1; 403/170–172, 176
See application file for complete search history.

(56) References Cited

U.S. PATENT DOCUMENTS

| | | | | |
|---|---|---|---|---|
| 1,973,536 | A * | 9/1934 | Mack | 446/103 |
| 2,682,235 | A * | 6/1954 | Fuller | 52/81.3 |
| 2,980,215 | A * | 4/1961 | Englund | 138/157 |
| 3,325,958 | A * | 6/1967 | Moore | 52/647 |
| 3,945,160 | A * | 3/1976 | Grosser et al. | 52/81.4 |
| 4,115,966 | A * | 9/1978 | DeLee | 52/148 |
| 4,233,656 | A * | 11/1980 | Shemitz | 362/352 |
| 4,343,117 | A * | 8/1982 | Shemitz | 52/91.1 |
| 5,354,589 | A * | 10/1994 | Wass | 428/61 |
| 5,996,288 | A * | 12/1999 | Aiken | 52/81.3 |
| 6,298,525 | B1 * | 10/2001 | Margo | 24/336 |
| 6,334,284 | B1 * | 1/2002 | Provitola | 52/698 |
| 6,412,232 | B1 * | 7/2002 | Provitola | 52/80.1 |
| 6,901,714 | B2 * | 6/2005 | Liapi | 52/645 |
| 7,069,699 | B2 * | 7/2006 | Provitola | 52/81.3 |
| 7,434,359 | B2 * | 10/2008 | Geiger | 52/81.3 |
| 7,802,404 | B2 | 9/2010 | Wolfram | |
| 7,886,406 | B2 * | 2/2011 | Chang | 16/252 |
| 7,992,353 | B2 | 8/2011 | Athan | |
| 8,820,006 | B2 * | 9/2014 | Zook | 52/81.3 |

FOREIGN PATENT DOCUMENTS

| | | | | |
|---|---|---|---|---|
| GB | 2281083 | A * | 2/1995 | E04B 1/19 |

* cited by examiner

*Primary Examiner* — Adriana Figueroa
(74) *Attorney, Agent, or Firm* — Paul Barenie, Esq.

(57) ABSTRACT

A geodesic frame system comprises a hub connector comprising a discontinuous ring and having a first ring opening and a second ring opening. The geodesic frame system further includes at least two elongated struts, each strut including a first end, a first strut opening greater than a hub connector cross-section and proximate the first end, a second end, and a second strut opening greater than the hub connector cross section and proximate the second end, where each elongated strut is capable of being coupled with the hub connector by insertion of the hub connector through the first strut opening. A wire piece having a wire piece diameter less than the first ring opening and the second ring opening is capable of being coupled with the hub connector by insertion through the first and second ring opening, is further included.

8 Claims, 9 Drawing Sheets

GEODESIC FRAME SYSTEM

TECHNICAL FIELD

This disclosure is directed to a structure, and more particularly, to a geodesic frame system.

BACKGROUND ART

Geodesic domes are rigid geometric structures that provide a large degree of stability while having a high strength to weight ratio. Geodesic dome structures are typically constructed of a frame having struts and hub connectors that are connected to form an interlocking triangle structure.

Geodesic domes may have many different frequencies and strut arrangements. A higher frequency dome has more struts and hub connectors, while providing a smoother dome shape. A lower frequency dome has less struts and connectors while providing a less smooth dome shape. As the frequency of the dome increases, the angle of inclination of the struts to the radial plane of the hub connector decreases. The strut angles of geodesic domes may be dependent on the frequency of the dome. Some hub connectors may vary depending on the number of struts being joined. Conventional geodesic frames typically comprise complex hub connector schemes that increase the complexity and difficulty in assembling the geodesic frame.

A frame system is described in U.S. Pat. No. 7,992,353 to Athan, that utilizes a six-strut hub requiring six pins and six caps to couple six tubular struts and a metal rod. Such a scheme requires a user to locate, sort and manipulate the several various components of the frame and hub during the assembly process. Such manipulation can be difficult and intimidating for a user to accomplish. Further, utilizing several such components, here the six pins and six caps per hub joint, requires the user to expend significant time when constructing each joint of the frame.

Another frame system is described in U.S. Pat. No. 7,802,404 to Wolfram, that utilizes more than one style hub configuration depending on the particular joint in the structure. In such a frame, a hub is constructed with designated slots to receive the multiple struts it is joining. Each strut is coupled with the hub using multiple pieces of hardware, for example, twenty-four bolts and twenty-four nuts, six struts, and a hub connector in the case of a six-strut hub. Further, the hub requires a complex manufacturing process requiring casting or welding, and the hub must be specifically designed for the number of struts it is joining. To construct a frame, a user of such a system must not only collect the many pieces of hardware for that frame joint, but must also determine and select the appropriate hub configuration to connect the appropriate number of struts at that hub joint. As multiple pieces of hardware are required for each hub joint, failure to tighten even one piece of hardware could create a potentially dangerous situation. Further, a frame system requiring so much hardware requires considerable construction time on behalf of the user. In addition, because multiple hub joint configurations are used depending on how many struts are being joined at the particular hub joint, it may be easy for a user to select the wrong hub connector, requiring the user to expend further time in disassembly and reassembly of the joint with the proper hub connector.

This invention is directed to solving one or more of the problems discussed above.

SUMMARY

Figure 1:
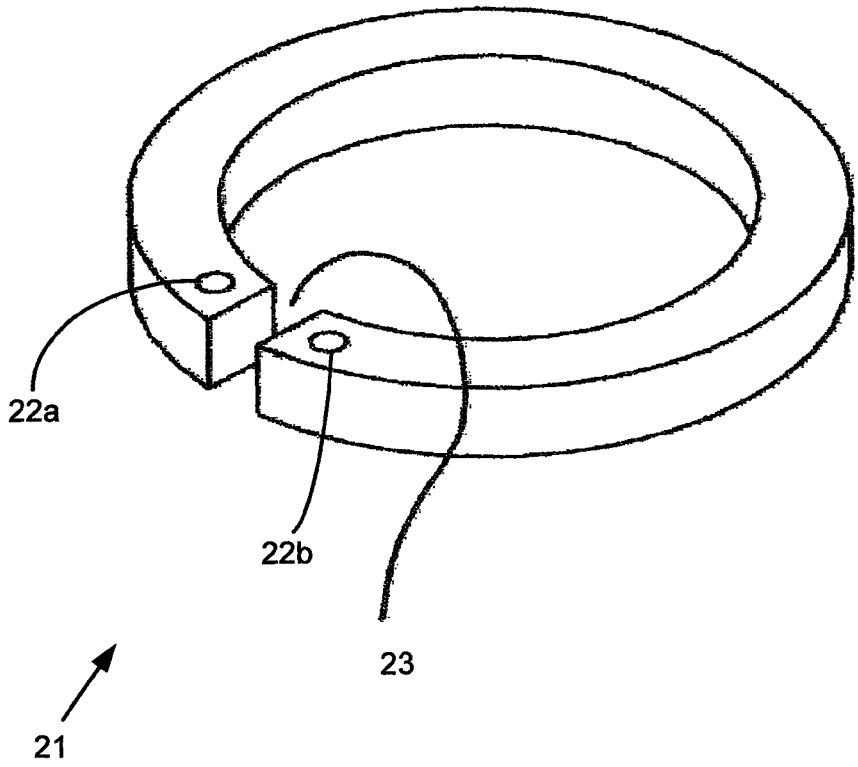
FIG. 1 is a perspective view of a hub connector, in accordance with an embodiment of the invention.

A geodesic frame system comprises a hub connector comprising a discontinuous ring and having a first ring opening and a second ring opening. The geodesic frame system further includes at least two elongated struts, each strut including a first end, a first strut opening greater than a hub connector cross-section and proximate the first end, a second end, and a second strut opening greater than the hub connector cross section and proximate the second end, where each elongated strut is capable of being coupled with the hub connector by insertion of the hub connector through the first strut opening. A wire piece having a wire piece diameter less than the first ring opening and the second ring opening is capable of being coupled with the hub connector by insertion through the first and second ring opening, is further included.

A geodesic frame system comprises a hub connector comprising a discontinuous ring and having a first ring opening and a second ring opening. The geodesic frame system further includes at least two elongated struts, each strut including a first end, a first strut opening greater than a hub connector cross-section and proximate the first end, a second end, and a second strut opening greater than the hub connector cross section and proximate the second end, where each elongated strut is capable of being coupled with the hub connector by insertion of the hub connector through the first strut opening. A wire piece having a wire piece diameter less than the first ring opening and the second ring opening is capable of being coupled with the hub connector by insertion through the first and second ring opening, is further included.

In one embodiment, each of the at least two elongated struts includes a first elongated strut and a second elongated strut. The first and second elongated struts each include an elongated strut first end, where the first strut opening is a first end first opening and the first end further includes a first end second opening greater than the cross section of the hub connector, and an elongated strut second end, where the second strut opening is a second end first opening and the second end further includes a second end second opening greater than the cross section of the hub connector.

In a further embodiment, the first and second elongated struts each have an elongated strut face that is trapezoid-shaped. The first end first opening and the first end second opening of the first and second elongated struts is parallel with a first end outer edge, and the second end first opening and the second end second opening of the first and second elongated struts is parallel with a second end outer edge.

In a further embodiment yet, the hub connector is a first hub connector, and the structure includes a second hub connector having a discontinuous ring shape and a second hub connector cross section less than the first end second openings of the first and second elongated struts. The elongated strut being capable of being coupled with the hub connector comprises the first and second elongated struts being capable of being coupled with the first hub connector by insertion of the first hub connector through the first end first openings of the first and second elongated struts, and the first and second elongated struts being capable of being coupled with the second hub connector by insertion of the second hub connector through the first end second openings of the first and second elongated struts.

In yet a further embodiment, the second hub connector includes a second hub connector first ring opening and a second hub connector second ring opening. The wire piece is capable of being coupled with the first and second hub connectors by insertion through the first ring openings of the first and second hub connectors and by insertion through the second ring openings of the first and second hub connectors.

In an alternate further embodiment, the first and second hub connectors each have a rectangular cross section, and the first end first and second openings and the second end first and second openings of the first and second elongated struts are rectangular in shape.

In another embodiment, the at least two elongated struts include a first elongated strut having an elongated strut face that is trapezoid-shaped, the first and second strut openings of the first elongated strut are rectangular in shape, and the hub connector has a rectangular cross section.

DETAILED DESCRIPTION OF THE PREFERRED EMBODIMENT

A geodesic frame system comprises a hub connector comprising a discontinuous ring and having a first ring opening and a second ring opening. The geodesic frame system further includes at least two elongated struts, each strut including a first end, a first strut opening greater than a hub connector cross-section and proximate the first end, a second end, and a second strut opening greater than the hub connector cross section and proximate the second end, where each elongated strut is capable of being coupled with the hub connector by insertion of the hub connector through the first strut opening. A wire piece having a wire piece diameter less than the first ring opening and the second ring opening is capable of being coupled with the hub connector by insertion through the first and second ring opening, is further included.

Various figures will be discussed to describe embodiments of the invention. One skilled in the art will realize that these figures may not necessarily be to scale. For the purpose of clarity, not all reference numbers are shown in all figures.

FIG. 1 is a perspective view of a ring shaped connector, here hub connector 21, in accordance with an embodiment of the invention. The hub connector 21 may be used as part of a geodesic frame structure. As shown in FIG. 1, the hub connector 21 has a discontinuous ring shape, the discontinuity here shown at a notched opening 23. The hub connector 21 further includes first and second ring openings/holes, here first and second ring openings 22*a* and 22*b*, respectively.

Figure 2A:
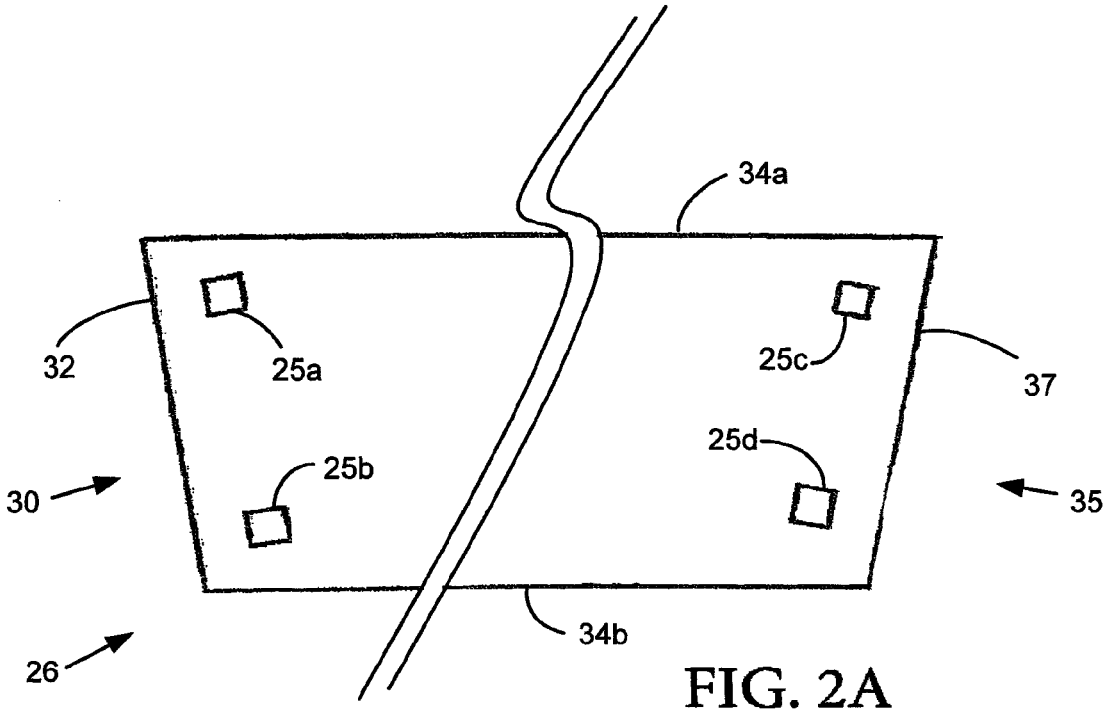
FIGS. 2A and 2B are front and perspective views, respectively, of an exemplary elongated strut that may be utilized with the hub connector of FIG. 1, in accordance with an embodiment of the invention.
Figure 2B:
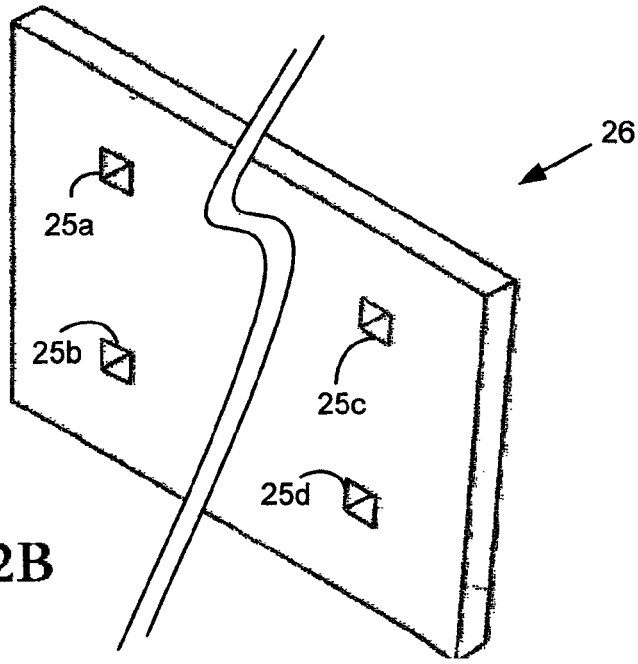

FIGS. 2A and 2B are front and perspective views, respectively, of an exemplary elongated strut 26 that may be combined with the hub connector 21 of FIG. 1 in a geodesic frame system, in accordance with an embodiment of the invention. As shown in FIGS. 2A and 2B, the elongated strut 26 may include a first end shown generally at 30 and having a first end outer edge 32. The elongated strut 26 may further have a second end shown generally at 35 having a second end outer edge 37. The first end 30 may include a first end first opening 25*a* and a first end second opening 25*b*, proximate and parallel with the first end outer edge 32, and the second end 35 may have second end first opening 25*c* and second end second opening 25*d*, proximate to and parallel with the second end outer edge 37. The first end first and second openings 25*a* and 25*b* and second end first and second openings 25*c* and 25*d* may be rectangular-shaped openings, sized to be larger than a cross section of the hub connector 21. As shown at the front (i.e., face) view of the elongated strut 26 of FIG. 2, the elongated strut may have a face that is a trapezoidal shape.

It will be appreciated by one skilled in the art, that the longer, top edge of the elongated strut shown at 34*a* may be oriented in an outwardly-facing direction of the geodesic frame structure, and the shorter, bottom edge, shown at 34*b* may be oriented in an inwardly-facing direction of the frame structure.

Figure 3:
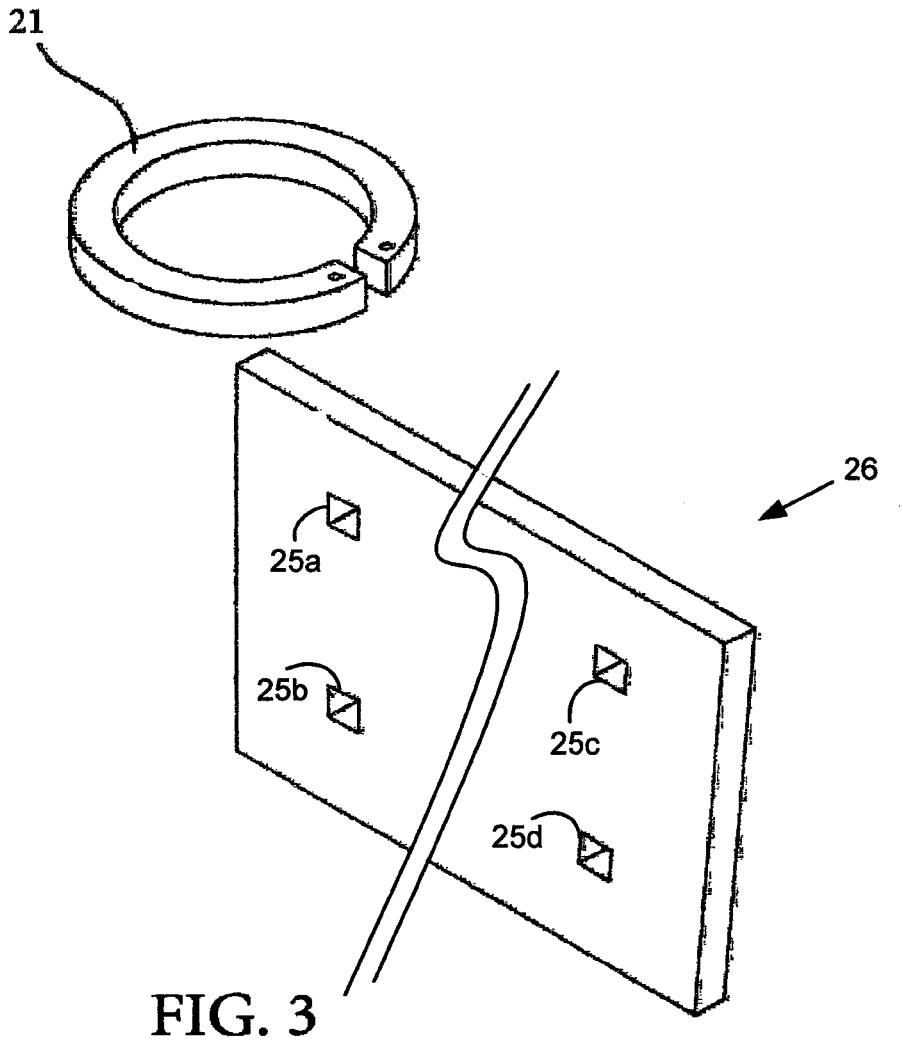
FIGS. 3-5 are perspective views illustrating coupling of the hub connector of FIG. 1 with an elongated strut, in accordance with an embodiment of the invention.
Figure 4:
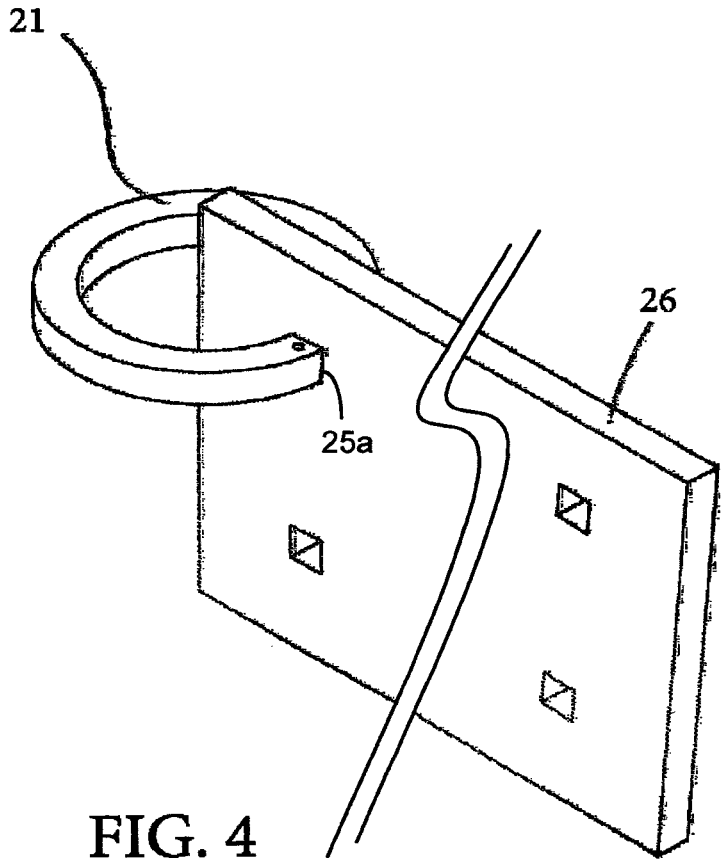
Figure 5:
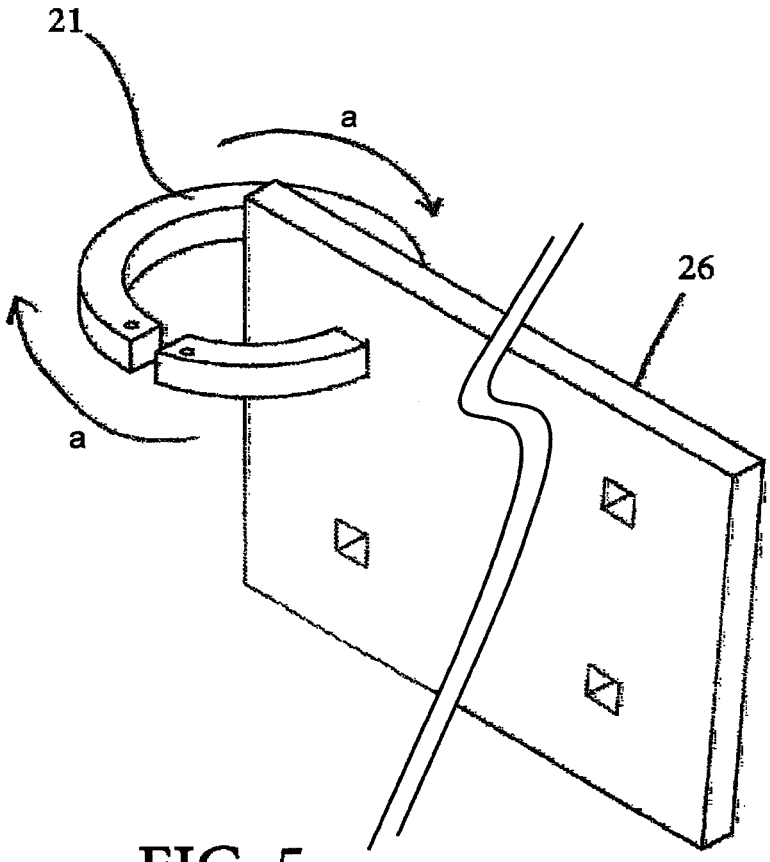

FIGS. 3-5 are perspective views illustrating coupling of the hub connector of FIG. 1 with a strut, in accordance with an embodiment of the invention. As shown at FIG. 3, the hub connector 21 may be located near one of the openings 25*a*-*d* of the elongated strut 26. As shown at FIG. 4, the hub connector 21 may be aligned with such opening, here the first end first opening 25*a*. As shown at FIG. 5, the hub connector may be coupled with the elongated strut 26 by rotating the hub connector 21, for example, in the direction indicated by arrow 'a', thereby inserting the hub connector 21 through the first end first opening 25*a*.

Figure 6:
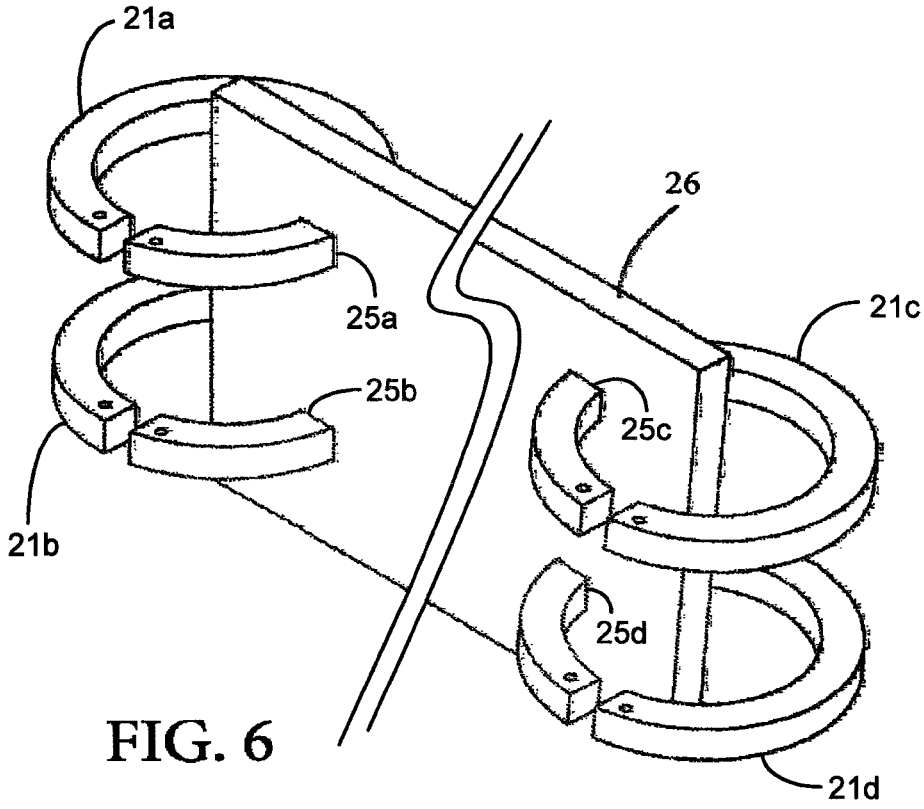
FIG. 6 is a perspective view of multiple hub connectors coupled with an elongated strut, in accordance with an embodiment of the invention.

FIG. 6 is a perspective view of multiple hub connectors coupled with an elongated strut, in accordance with an embodiment of the invention. As shown in FIG. 6, the hub connector 21*a* may be coupled with the hub 26 at the first end first opening 25*a*, and the hub connector 21*b* may be coupled with the elongated strut 26 at the first end second opening 25*b*. The hub connector 21*c* may be coupled with the hub 26 at the second end first opening 25*c*, and the hub connector 21*d* may be coupled with the elongated strut 26 at the second end second opening 25*d*. The hub connectors 21*a*, 21*b*, 21*c* and 21*d* may be coupled with the strut 26 in a similar fashion as described above with respect to FIGS. 3-5.

Figure 7:
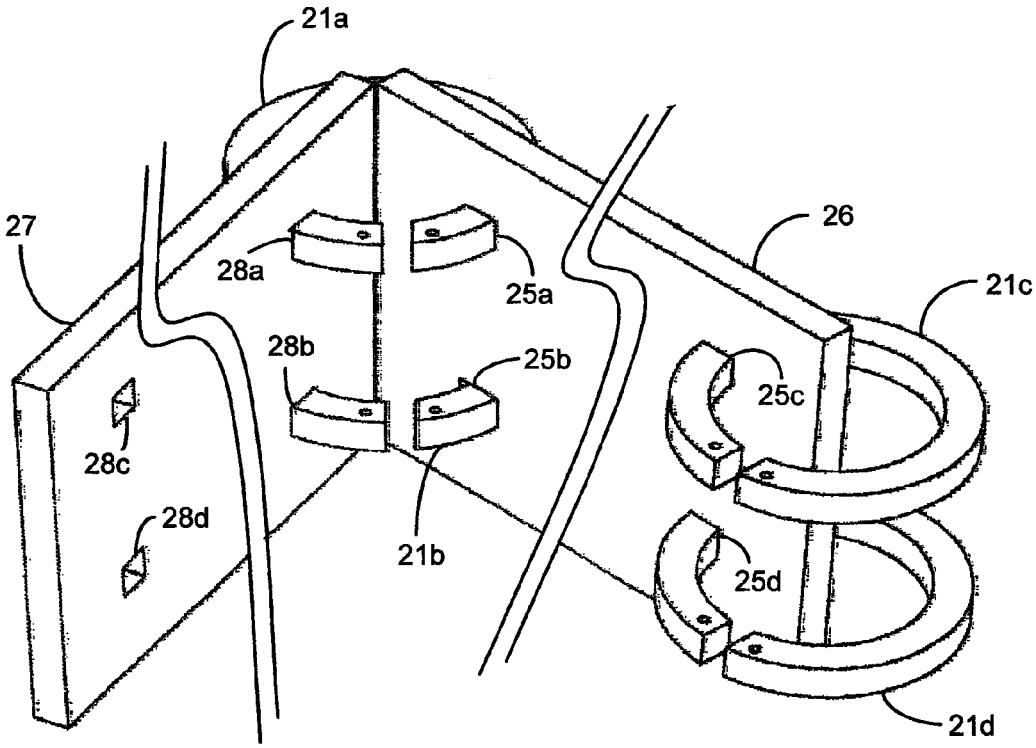
FIG. 7 is a perspective view of two elongated struts coupled by the hub connector of FIG. 1, in accordance with an embodiment of the invention.

FIG. 7 is a perspective view of two struts coupled by the hub connector of FIG. 1, in accordance with an embodiment of the invention. As shown in FIG. 7, the hub connector 21*a* and hub connector 21*b* may be used to couple the elongated strut 26 with an elongated strut 27. The hub connector 21*a* may be aligned with and rotated through the first end first opening 25*a* of the first elongated strut 26, in a similar fashion as described above with respect to FIGS. 3-5. In a similar fashion, the hub connector 21*b* may be aligned with and rotated through the first end second opening 25*b* of the elongated strut 26. The notched openings of the hub connectors 21*a* and 21*b* may be aligned to face the same direction. The second elongated strut 27, specifically, the first end first and second openings 28*a* and 28*b*, may be aligned with the hub connectors 21*a* and 21*b*. The hub connectors 21*a* and 21*b* may be coupled with the elongated strut 27 by rotating the hub connectors 21*a* and 21*b*, to insert the hub connectors 21*a* and 21*b* through the first end first and second openings 28*a* and 28*b* of the elongated strut 27. Rotating the hub connector to insert it into an opening of the elongated strut may be accomplished by hand, or instead may be accomplished using a pry bar.

Figure 8:
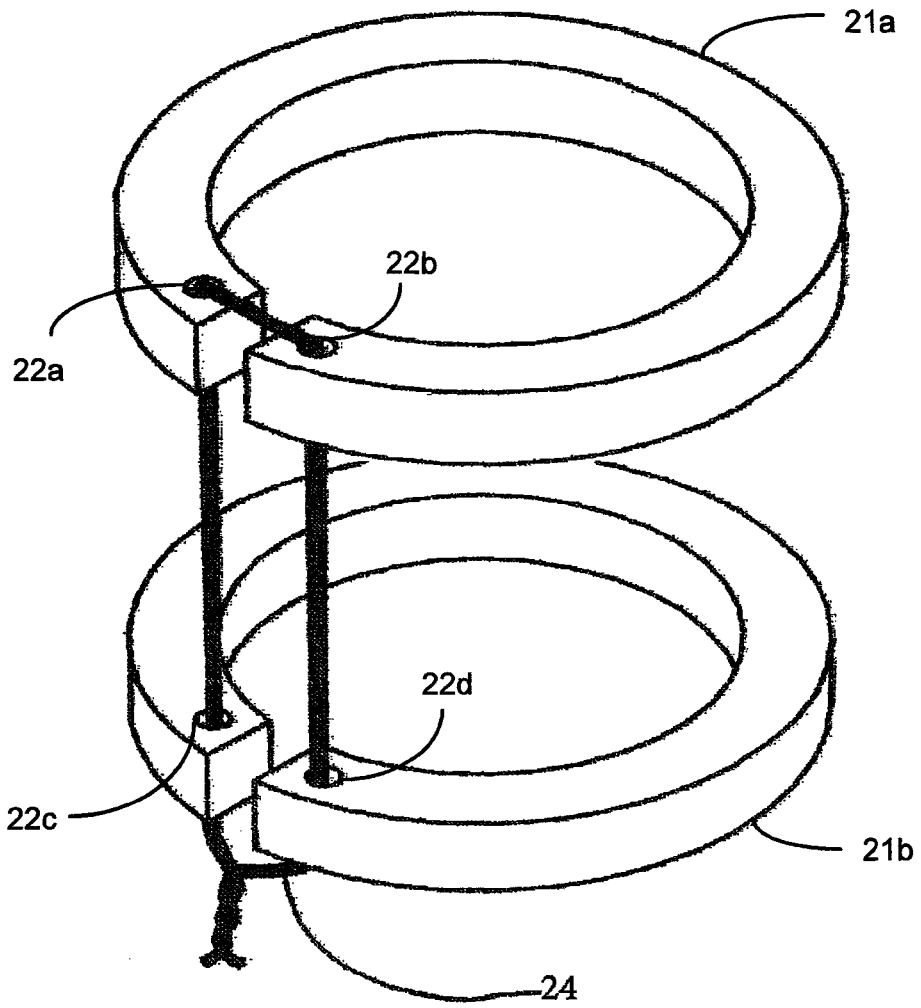
FIG. 8 is a perspective view illustrating the locking of connector hubs, in accordance with an embodiment of the invention.

FIG. 8 is a perspective view illustrating the locking of connector hubs, in accordance with an embodiment of the invention. The elongated struts have been omitted from FIG. 8 for the purpose of clarity.

As shown in FIG. 8, the first hub connector 21*a* and the second hub connector 21*b* may be locked using a wire piece 24. Here, the first hub connector 21*a* has first and second ring openings 22*a* and 22*b*, and the second hub connector 21*b* similarly has first and second ring openings 22*c* and 22*d*. As shown, the wire piece 24 may be inserted through the first ring openings 22*a*, 22*c*. The wire piece 24 may further be inserted through the second ring openings 22*b* and 22*d*. Further, as shown, the ends of the wire piece 24 may be coupled together, for example, by twisting. The wire piece 24 may thus serve to lock one or both of the hub connectors 21*a* and 21*b* from rotation out of its respective elongated strut opening (i.e., openings 25*a*, 25*b*, 25*c*, and/or 25*d*), thus preventing decoupling of the elongated struts being held together by the hub connector.

Figure 9:
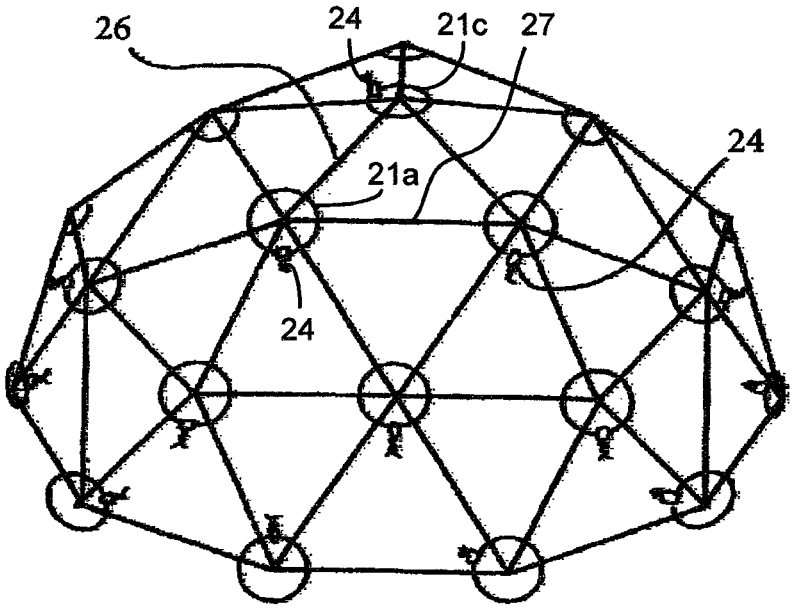
FIG. 9 is a perspective view of a geodesic frame system constructed using the hub connector of FIG. 1, in accordance with an embodiment of the invention.

FIG. 9 is a perspective view of a geodesic frame system constructed using the hub connector of FIG. 1, in accordance with an embodiment of the invention. As shown in FIG. 9, multiple elongated struts may be coupled together using hub connectors. For example, as shown, the elongated strut 26 may be coupled with elongated strut 27 at a hub joint using hub connector 21*a* in a fashion similar to as described above with respect to FIGS. 3-5. Further shown, wire piece 24 may be used to lock the hub connector 21*a* from rotation, thereby preventing the hub connector 21*a* from decoupling from the elongated struts 26 and 27. Further shown, the hub connector 21*c* couples elongated strut 26 with other elongated struts of the frame structure. Though FIG. 9 shows only one hub connector being utilized at a hub joint to couple adjacent elongated struts together, it will be appreciated that more than one hub connector may be utilized at each hub joint, for example, as described above with respect to FIG. 7.

The hub connector and struts may be formed, for example from carbon steel. Other materials, for example, aluminum, stainless steel, brass, plywood or wood boards may be utilized. It will be appreciated that one vertex/hub joint in the geodesic dome or space frame may be coupled with a single hub connector, or instead be coupled using multiple hub connectors stacked above each other for more strength. In any event, all the hub connectors may be the same shape and size for all vertices in the frame structure. In addition, the elongated struts may be of varying lengths in a frame structure, depending on the particular shape and configuration of the structure, and the location in the frame structure.

Further, except for the wire, all the components, such as the elongated struts and the hub connectors of the geodesic frame system, may be flat and formed from a flat material. Thus, for example, plate steel may be placed on a computer controlled plasma-cutting table. The plasma-cutting table could be programmed to cut all the hub connectors and struts. Thus, none of welding, casting, threading, mechanical pressing or bending would be required in making the pieces of the frame structure.

As described herein, a frame structure may be constructed using less complex hub connectors at its joints/vertices. As the hub connector allows for coupling any number of strut members, the hub connector described herein may be utilized at any joint/vertex of the frame structure. Thus, there is no need to sort through various hub connector configurations as required in conventional structures when assembling the frame structure, thereby reducing assembly time. Having a single hub connector configuration as described herein eliminates the chance of an improper hub connector configuration being selected for a particular frame joint, that would require disassembly and reassembly of the joint with the proper hub connector.

As described and shown, the hub connector may have a key-fit configuration with various elongated struts forming a hub joint, here where the rectangular hub connector cross section is similar to but slightly smaller than the rectangular openings in the elongated strut. Thus, a frame structure may be constructed as shown in FIG. 9 using one hub connector per hub joint, or as shown at FIG. 7 where multiple, stacked hub connectors are utilized at each hub joint to provide greater strength at the hub joint.

As the hub connector described herein may be locked into place using just a single component, here a wire piece, there is no need to compile a stack of hardware in order to assemble a vertex of the structure. This may reduce assembly time, and reduces the risk of a potentially hazardous situation of conventional geodesic frame systems where hardware required in conventional designs is not properly tightened. Further, the hub connector may be used with elongated struts of varying length and angle regardless of the length of the struts or inclination angle of the particular hub joint.

In addition, assembly of the frame structure doesn't involve or require power tools or specialized tools. Rather, the frame structure may be constructed by aligning hub connectors and struts, rotating the hub connectors, for example, using a pry par if necessary, and locking the connector hubs using wire pieces.

While various embodiments of the disclosure have been described, it will be apparent to those of ordinary skill in the art that many more embodiments and implementations are possible within the scope of the disclosure. Accordingly, the disclosure is not to be restricted except in light of the attached claims and their equivalents.

I claim:

1. A geodesic frame system comprising:

a plurality of ring shaped connectors, each ring shaped connector including a rectangular end, a notched opening, and a first hole and second hole;

a plurality of elongated struts of varying lengths, each elongated strut having an end with a first rectangular strut hole and a second rectangular strut hole; and a plurality of wire pieces each having a first wire piece end and a second wire piece end;

wherein a rectangular end of a first ring shaped connector of the plurality of ring shaped connectors is coupled with a first elongated strut of the plurality of elongated struts by insertion and rotation through a first rectangular strut hole of the first elongated strut, the rectangular end of the first ring shaped connector is coupled with a second elongated strut of the plurality of elongated struts by insertion and rotation through a first rectangular strut hole of the second elongated strut, a rectangular end of a second ring shaped connector of the plurality of ring shaped connectors is coupled with the first elongated strut by insertion and rotation through a second rectangular strut hole of the first elongated strut, the rectangular end of the second ring shaped connector is coupled with the second elongated strut by insertion and rotation through a second rectangular strut hole of the second elongated strut, a wire piece of the plurality of wire pieces having a first end and a second end is coupled with the first and second ring shaped connectors with the first end of the wire piece being inserted through a first hole of the first and second ring shaped connector and inserted through a second hole of the first and second ring shaped connectors, where the first and second end of the wire piece is twisted together to form a loop.

2. A geodesic frame system, comprising:

a hub connector comprising a discontinuous ring and having a first ring opening and a second ring opening;

at least two elongated struts, each strut including a first end, a first strut opening greater than a hub connector cross-section and proximate the first end, a second end, and a second strut opening greater than the hub connector cross section and proximate the second end, where each elongated strut is capable of being coupled with the hub connector by insertion of the hub connector through the first strut opening; and a wire piece having a wire piece diameter less than the first ring opening and the second ring opening, where the wire piece is capable of being coupled with the hub connector by insertion through one of the first and second ring opening.

3. The geodesic frame system of claim 2, wherein each of the at least two elongated struts includes a first elongated strut and a second elongated strut, where the first and second elongated struts each include an elongated strut first end, where the first strut opening is a first end first opening and the first end further includes a first end second opening greater than the cross section of the hub connector, and an elongated strut second end, where the second strut opening is a second end first opening and the second end further includes a second end second opening greater than the cross section of the hub connector.

4. The geodesic frame system of claim 3, wherein the first and second elongated struts each have an elongated strut face that is trapezoid-shaped, and where the first end first opening and the first end second opening of the first and second elongated struts is parallel with a first end outer edge, and the second end first opening and the second end second opening of the first and second elongated struts is parallel with a second end outer edge.

5. The geodesic frame system of claim 4, wherein the hub connector is a first hub connector, and further comprising a second hub connector having a discontinuous ring shape and a second hub connector cross section less than the first end second openings of the first and second elongated struts, and where the elongated strut being capable of being coupled with the hub connector comprises the first and second elongated struts being capable of being coupled with the first hub connector by insertion of the first hub connector through the first end first openings of the first and second elongated struts, and the first and second elongated struts being capable of being coupled with the second hub connector by insertion of the second hub connector through the first end second openings of the first and second elongated struts.

6. The geodesic frame system of claim 5, wherein the second hub connector includes a second hub connector first ring opening and a second hub connector second ring opening, and the wire piece being capable of being coupled with the hub connector includes the wire piece being capable of being coupled with first and second hub connectors by insertion through the first ring openings of the first and second hub connectors and by insertion through the second ring openings of the first and second hub connectors.

7. The geodesic frame system of claim 5, wherein the first and second hub connectors each have a rectangular cross section, and where the first end first and second openings and the second end first and second openings of the first and second elongated struts are rectangular in shape.

8. The geodesic frame system of claim 2, wherein the at least two elongated struts include a first elongated strut having an elongated strut face that is trapezoid-shaped, and where the first and second strut openings of the first elongated strut are rectangular in shape, and the hub connector has a rectangular cross section.

* * * * *